US011702722B2

(12) United States Patent
Kissling et al.

(10) Patent No.: US 11,702,722 B2
(45) Date of Patent: Jul. 18, 2023

(54) PLATINUM ALLOY

(71) Applicant: Nivarox-FAR S.A., Le Locle (CH)

(72) Inventors: Gregory Kissling, La Neuveville (CH); Vincent Fays, Saint-Blaise (CH); Jonas Vannod, Bienne (CH); Christian Charbon, Chézard-St-Martin (CH); Denis Vincent, Neuchâtel (CH); Stéphane Lauper, Cortaillod (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 17/975,827

(22) Filed: Oct. 28, 2022

(65) Prior Publication Data

US 2023/0183839 A1 Jun. 15, 2023

(30) Foreign Application Priority Data

Dec. 14, 2021 (EP) ..... 21214514

(51) Int. Cl.
*C22C 5/04* (2006.01)

(52) U.S. Cl.
CPC ..... *C22C 5/04* (2013.01)

(58) Field of Classification Search
CPC ..... C22C 5/04; C22F 1/14
See application file for complete search history.

(56) References Cited

FOREIGN PATENT DOCUMENTS

| | | | |
|---|---|---|---|
| EP | 3502286 | A1 | 6/2019 |
| JP | 2018-021243 | A | 2/2018 |
| WO | 97/40200 | A1 | 10/1997 |
| WO | 2015/193659 | A2 | 12/2015 |
| WO | 2015/193659 | A3 | 12/2015 |

OTHER PUBLICATIONS

European Search Report of No. 21214514.8 dated May 18, 2022.

*Primary Examiner* — Jessee R Roe
(74) *Attorney, Agent, or Firm* — Sughrue Mion, PLLC

(57) ABSTRACT

A platinum alloy consisting, by weight, of the following elements: 95.00 to 96.00% of Pt, 1.00 to 4.95% of Ru, 0.05 to 2.00% of Ge, 0 to 2.00% of Au, any impurities with a total content 0.50%.

19 Claims, No Drawings

PLATINUM ALLOY

CROSS REFERENCE TO RELATED APPLICATIONS

This application is claiming priority based on European Patent Application No. 21214514.8 filed on Dec. 14, 2021, the disclosure of which is incorporated herein in its entirely by reference.

TECHNICAL FIELD OF THE INVENTION

The present invention relates to a platinum alloy. The invention also relates to an item, particularly to a decorative item, and more specifically to a timepiece component, made from this alloy.

TECHNOLOGICAL BACKGROUND

There are several families of platinum-based alloys on the market used in watchmaking and jewellery. These alloys have the particular feature of being mainly used at an internationally recognised grade of 95% by weight, which significantly limits the content of alloying elements. The alloying elements will therefore meet a technical constraint specific to the element. The first conventional alloying elements are ruthenium, cobalt, copper, iridium. Platinum alloys containing ruthenium have a universal use for jewellery and watchmaking particularly for machined products. Platinum alloy containing ruthenium has the feature of being the whitest platinum alloy on the market. Unfortunately, this alloy is difficult to cast due to its high casting temperature and its relatively low melting range. In addition, this alloy only lends itself to traditional machining techniques such as profile-turning, milling and drilling.

SUMMARY OF THE INVENTION

The object of the present invention is to overcome the aforementioned drawbacks by proposing a novel platinum alloy dazzling with whiteness, easy to cast while having a good suitability for machining.

To this end, the present invention relates to a platinum alloy consisting by weight, of 95.00 to 96.00% of Pt, of 1.00 to 4.95% of Ru, of 0.05 to 2.00% of Ge, of 0 to 2.00% of Au and of any impurities with a total content less than or equal to 0.50%.

Preferably, the Ru content is between 2.00 and 4.95% by weight. More preferably, it is between 3.00 and 4.95% by weight. Particularly preferably, the Ru content is between 3.50 and 4.80% by weight.

Preferably, the Ge content is between 0.05 and 1.50% by weight. More preferably, it is between 0.05 and 1.00% by weight. Particularly preferably, the Ge content is between 0.07 and 0.70% by weight.

Preferably, the Au content is between 0.05 and 1.50% by weight. More preferably, the Au content is between 0.10 and 1.00% by weight. Particularly preferably, the Au content is between 0.10 and 0.70% by weight.

Ruthenium brings a certain hardness and the whiteness of the alloy. The addition of germanium significantly increases the hardness of the alloy. In addition, the addition of germanium increases the machinability of the alloy and makes it possible to increase the melting range while reducing the casting temperature. The addition of gold has this same benefit on the machinability and the castability.

Typically, the alloy according to the invention has a yellowness index Yi10° between 7 and 8 and a HV2 hardness between 140 and 230.

Advantageously, the alloy according to the invention has a face-centred cubic type single-phased structure, free of intermetallic precipitations such as GePt3, GePt2, Ge2Pt3, GePt, Ge3Pt2, GeRu, which would reduce the hardness by solid solution and could generate defects during polishing steps (presence of hard spots).

The composition of this alloy therefore makes it possible to achieve an excellent compromise between hardness, machinability and castability and this without negatively affecting the white colour of the alloy.

The present invention also relates to an item and in particular a timepiece component made from this alloy.

DETAILED DESCRIPTION OF THE INVENTION

The alloy of the present invention is a platinum alloy at the grade of 95% by weight.

According to the invention, the platinum alloy consists by weight, of 95.00 to 96.00% of Pt, of 1.00 to 4.95% of Ru, of 0.05 to 2.00% of Ge, of 0 to 2.00% of Au and of any impurities with a total content 0.50%. The alloy consists of these various elements and impurities, that is to say that all of the Pt, Ru, Ge, Au and any impurities reach the percentage of 100%.

Preferably, the Ru content is between 2.00 and 4.95% by weight. More preferably, it is between 3.00 and 4.95% by weight. Particularly preferably, the Ru content is between 3.50 and 4.80% by weight.

Preferably, the Ge content is between 0.05 and 1.50% by weight. More preferably, it is between 0.05 and 1.00% by weight. Particularly preferably, the Ge content is between 0.07 and 0.70% by weight.

Preferably, the Au content is between 0.05 and 1.50% by weight. More preferably, the Au content is between 0.10 and 1.00% by weight. Particularly preferably, the Au content is between 0.10 and 0.70% by weight.

Advantageously, according to a first variant, the platinum alloy consists, by weight, of 95.00 to 96.00% of Pt, of 2.00 to 4.90% of Ru, of 0.05 to 1.50% of Ge, of 0.05 to 1.50% of Au and of any impurities with a total content 0.50%.

Advantageously, according to a second variant, the platinum alloy consists, by weight, of 95.00 to 96.00% of Pt, of 3.00 to 4.85% of Ru, of 0.05 to 1.00% of Ge, of 0.10 to 1.00% of Au and of any impurities with a total content 0.50%.

Advantageously, according to a third variant, the platinum alloy consists, by weight, of 95.00 to 96.00% of Pt, of 3.50 to 4.83% of Ru, of 0.07 to 0.70% of Ge, of 0.10 to 0.70% of Au and of any impurities with a total content 0.50%.

The platinum alloy according to the invention particularly applies to the production of a timepiece component and more specifically of an external part timepiece component such as a middle, a back, a bezel, a push-piece, a crown, a bracelet link, a bracelet clasp, a dial, a hand and a dial index. Generally, this alloy may be used for any item and more specifically any decorative item, for example, in the field of jewellery.

The alloy according to the invention has a HV2 hardness between 140 and 230, and optionally between 150 and 210 and a yellowness index Yi10° such as defined hereafter between 7 and 8.

Advantageously, the alloy according to the invention has a face-centred cubic type single-phased structure, free of intermetallic precipitations such as GePt3, GePt2, Ge2Pt3, GePt, Ge3Pt2, GeRu.

To prepare the platinum alloy according to the invention, the procedure is as follows:

- The main elements incorporated into the composition of the alloy have a purity between 999 and 999.9 per thousand and are deoxidised.
- The elements of the composition of the alloy are placed in a crucible that is heated until the elements melt.
- The heating is carried out in an airtight induction furnace under partial pressure of argon
- The molten alloy is cast in an ingot-mould.
- After solidification, the ingot is optionally subjected to water quenching.
- The cooled ingot is subsequently cold rolled then annealed. The degree of cold-working between each annealing is 40 to 80%.
- Each annealing lasts 20 to 120 minutes and is carried out between 900° C. and 1100° C. under a reducing atmosphere consisting of pure $H_2$ or of a mixture of $H_2$ and $N_2$.
- The cooling after the annealing operations is carried out by water quenching or open-air cooling.

The colorimetric values and the hardness of various alloys according to the invention prepared with the method described above are given in Table 1 with a comparative example. The composition of Comparative Example No. 1 is devoid of germanium and includes gold and ruthenium. Samples No. 2 to No. 11 include gold and germanium while Samples No. 12 and No. 13 do not include gold. The measurements are taken on annealed and polished samples.

The L*a*b* colorimetric values in the CIELAB colorimetric space (in accordance with IEC No. 15, ISO 7724/1, DIN 5033 Teil 7, ASTM E-1164) have been measured with a KONICA MINOLTA Cm-2600d spectrophotometer with a D65 illuminant and a viewing angle of 10°. The Yellowness index Yi10° which is an indicator of the whiteness of the alloy has been calculated based on L*a*b* values according to ASTM E313. The lower this index, the whiter the alloy.

A significant and almost linear increase of the hardness is observed with the addition of germanium in Alloys No. 2 to No. 13 while maintaining a similar yellowness index that is between the 7 to 8 range. The alloys according to the invention have a hardness between 150 and 196 HV2 in relation to 138 HV2 for the Reference Alloy No. 1 without germanium. The addition of a low content of germanium with a content of 0.1% by weight in Alloys No. 5 and 7 already has a significant effect with a hardness value reaching 150 HV2. With an addition of 0.5% by weight of germanium, the hardness rises to 196 HV2. It can be observed that the addition of germanium has a significant effect on the hardness whether or not the alloy includes gold.

TABLE 1

| | (% by weight) | | | | | | | | | |
|---|---|---|---|---|---|---|---|---|---|---|
| | | Composition | | | | Colorimetry | | | | |
| | No. | Pt | Ru | Au | Ge | L | a* | b* | Yi10° | HV2 |
| Comparative | 1 | 95.3 | 4.2 | 0.5 | / | 88.2 | 0.8 | 3.5 | 7.6 | 138 |
| Invention | 2 | 95.3 | 3.7 | 0.5 | 0.5 | 87.9 | 0.8 | 3.5 | 7.8 | 196 |
| | 3 | 95.3 | 4.0 | 0.5 | 0.2 | 88.3 | 0.7 | 3.4 | 7.4 | 166 |
| | 4 | 95.3 | 4.0 | 0.4 | 0.3 | 88.3 | 0.7 | 3.3 | 7.2 | 181 |
| | 5 | 95.3 | 4.2 | 0.4 | 0.1 | 88.3 | 0.7 | 3.4 | 7.4 | 150 |

TABLE 1-continued

| | (% by weight) | | | | | | | | | |
|---|---|---|---|---|---|---|---|---|---|---|
| | | Composition | | | | Colorimetry | | | | |
| | No. | Pt | Ru | Au | Ge | L | a* | b* | Yi10° | HV2 |
| | 6 | 95.3 | 4.2 | 0.2 | 0.3 | 88.3 | 0.7 | 3.3 | 7.2 | 171 |
| | 7 | 95.3 | 4.2 | 0.4 | 0.1 | 88.3 | 0.7 | 3.3 | 7.3 | 150 |
| | 9 | 95.3 | 4.2 | 0.3 | 0.2 | 88.2 | 0.7 | 3.3 | 7.2 | 159 |
| | 10 | 95.3 | 4.2 | 0.2 | 0.3 | 88.1 | 0.7 | 3.4 | 7.4 | 172 |
| | 11 | 95.3 | 4.2 | 0.1 | 0.4 | 88.2 | 0.7 | 3.3 | 7.2 | 186 |
| | 12 | 95.3 | 4.45 | / | 0.25 | 88.0 | 0.7 | 3.4 | 7.5 | 169 |
| | 13 | 95.3 | 4.55 | / | 0.15 | 88.4 | 0.7 | 3.2 | 7.1 | 153 |

The invention claimed is:

1. A platinum alloy consisting, by weight, of the following elements:

95.00 to 96.00% of Pt,
1.00 to 4.95% of Ru,
0.05 to 2.00% of Ge,
0 to 2.00% of Au, and
any impurities with a total content≤0.50%.

2. The platinum alloy according to claim 1, wherein the Ru content is between 2.00 and 4.95% by weight.

3. The platinum alloy according to claim 1, wherein the Ru content is between 3.00 and 4.95% by weight.

4. The platinum alloy according to claim 1, wherein the Ru content is between 3.50 and 4.80% by weight.

5. The platinum alloy according to claim 1, wherein the Ge content is between 0.05 and 1.50% by weight.

6. The platinum alloy according to claim 1, wherein the Ge content is between 0.05 and 1.00% by weight.

7. The platinum alloy according to claim 1, wherein the Ge content is between 0.07 and 0.70% by weight.

8. The platinum alloy according to claim 1, wherein the Au content is between 0.05 and 1.50% by weight.

9. The platinum alloy according to claim 1, wherein the Au content is between 0.10 and 1.00% by weight.

10. The platinum alloy according to claim 1, wherein the Au content is between 0.10 and 0.70% by weight.

11. The platinum alloy according to claim 1, wherein the alloy consists, by weight, of 95.00 to 96.00% of Pt, of 2.00 to 4.90% of Ru, of 0.05 to 1.50% of Ge, of 0.05 to 1.50% of Au and of any impurities with a total content≤0.50%.

12. The platinum alloy according to claim 1, wherein the alloy consists, by weight, of 95.00 to 96.00% of Pt, of 3.00 to 4.85% of Ru, 0.05 and 1.00% of Ge, of 0.10 to 1.00% of Au and of any impurities with a total content≤0.50%.

13. The platinum alloy according to claim 1, wherein the alloy consists, by weight, of 95.00 to 96.00% of Pt, of 3.50 to 4.83% of Ru, 0.07 and 0.70% of Ge, of 0.10 to 0.70% of Au and of any impurities with a total content≤0.50%.

14. The platinum alloy according to claim 1, wherein the alloy has a HV2 hardness between 140 and 230 and a yellowness index Yi10° between 7 and 8.

15. The platinum alloy according to claim 1, wherein its structure is face-centred cubic single-phased, free of intermetallic precipitations.

16. An item made of platinum alloy according to claim 1.

17. The item according to claim 16, wherein the item is a decorative item.

18. The item according to claim 16, wherein the item is a timepiece component selected from the group comprising a middle, a back, a bezel, a push-piece, a crown, a bracelet link, a bracelet clasp, a dial, a hand and a dial index.

19. The platinum alloy according to claim 1, wherein the alloy has a HV2 hardness between 150 and 210 and a yellowness index Yi10° between 7 and 8.

* * * * *